US006093057A

United States Patent [19]

Lok

[11] Patent Number: 6,093,057

[45] Date of Patent: Jul. 25, 2000

[54] CONNECTOR ASSEMBLY FOR CONNECTING AN ELECTRICAL DEVICE TO AN EXTERNAL POWER SUPPLY

[75] Inventor: Gordon Lok, Montebello, Calif.

[73] Assignee: Hon Hai Precision IND. Co., Ltd., Taipei Hsien, Taiwan

[21] Appl. No.: 09/191,363

[22] Filed: Nov. 13, 1998

[51] Int. Cl.[7] ..... H01R 13/648

[52] U.S. Cl. ..... 439/607; 439/353

[58] Field of Search ..... 439/607, 610, 439/357, 345, 353, 79

[56] References Cited

U.S. PATENT DOCUMENTS

| | | | |
|---|---|---|---|
| Re. 32,502 | 9/1987 | Kumar | 439/92 |
| 4,718,866 | 1/1988 | Yamaguchi | 439/607 |
| 4,906,208 | 3/1990 | Nakamura et al. | 439/607 |
| 4,938,704 | 7/1990 | Fujiura | 439/95 |
| 4,993,971 | 2/1991 | Matsuzaki et al. | 439/607 |
| 5,178,557 | 1/1993 | Hashiguchi | 439/357 |
| 5,383,794 | 1/1995 | Davis et al. | 439/352 |
| 5,486,117 | 1/1996 | Chang | 439/357 |

*Primary Examiner*—Gary F. Paumen
*Assistant Examiner*—Truc Nguyen
*Attorney, Agent, or Firm*—Wei Te Chung

[57] ABSTRACT

An electrical connector assembly includes a receptacle connector disposed in an electrical device and a plug connector connected to an external power supply. A metal shield is formed by stamping a metal sheet and has latching portions outwardly extending from side walls thereof. Engaging arms rearwardly extend from the shield for securely engaging with corresponding apertures defined in a housing of the receptacle connector. Each latching portion defines a square opening therein for receiving a resilient latch of the plug connector. Each latch has a first portion outwardly extending from a mating face of the plug connector, a second portion connected to the first portion and extending toward the mating face, and a third portion connected to the second portion and extending toward the first portion.

1 Claim, 6 Drawing Sheets

CONNECTOR ASSEMBLY FOR CONNECTING AN ELECTRICAL DEVICE TO AN EXTERNAL POWER SUPPLY

BACKGROUND OF THE INVENTION

1. Field of The Invention

The present invention relates to an electrical connector assembly, and particularly to an electrical connector assembly for connecting an electrical device to an external power supply wherein the assembly has an EMI shield which strengthens the engagement between a receptacle connector and a plug connector thereof.

2. The Prior Art

A portable electronic device, such as a cellular telephone, is commonly driven by an internal power supply such as a rechargeable battery. In order to conserve the stored energy of the internal power supply, the electronic device can be connected to an external power supply such as a cigarette lighter in an automobile.

Electrical connector assemblies for connecting a portable electrical appliance to an external power supply are disclosed in U.S. Pat. Nos. 5,234,353 and 5,584,713. However, such an assembly does not provide protection from electromagnetic interference (EMI) thus signal transmission between the external power supply and the electrical appliance may be adversely affected. The conventional connector assembly also does not provide a grounding path for accumulated charges on a surface of either the assembly or the electrical appliance thereby further risking improper signal transmission. Furthermore, the engagement between plug and receptacle connectors of the assembly is not secure enough to prevent disconnection therebetween due to an external pulling force.

Hence, an improved electrical connector assembly is requisite to overcome the disadvantages of the prior art.

SUMMARY OF THE INVENTION

Accordingly, an objective of the present invention is to provide an electrical connector assembly for connecting an electrical device to an external power supply, having a firmly secured metal shield for minimizing the effects of EMI thereto.

Another objective of the present invention is to provide an electrical connector assembly having a metal shield connected to a grounding path of a PC board for facilitating electrostatic discharge (ESD) of accumulated surface charges.

A further objective of the present invention is to provide an electrical connector assembly having engagement means for firmly securing a receptacle connector to a mating plug connector thereof whereby disengagement caused by an external pulling force can be sufficiently resisted.

To fulfill the above mentioned objectives, an electrical connector assembly in accordance with the present invention includes a receptacle connector disposed in an electrical device and a plug connector connected to an external power supply. A metal shield attached to a housing of the receptacle connector forms a pair of latching portions outwardly extending from opposite sides thereof. Each latching portion defines a square opening therein for receiving a corresponding resilient latch extending from the plug connector. Each latch has a first portion outwardly extending from the plug connector, a second portion connected to the first portion and extending toward the plug connector, and a third portion connected to the second portion and extending toward the first portion. Engaging arms rearwardly extend from the shield for securely engaging with corresponding apertures defined in the housing.

These and additional objectives, features, and advantages of the present invention will become apparent after reading the following detailed description of the preferred embodiment taken in conjunction with the appended drawing figures.

DETAILED DESCRIPTION OF THE PREFERRED EMBODIMENT

Reference will now be made in detail to the preferred embodiment of the present invention.

Figure 1:
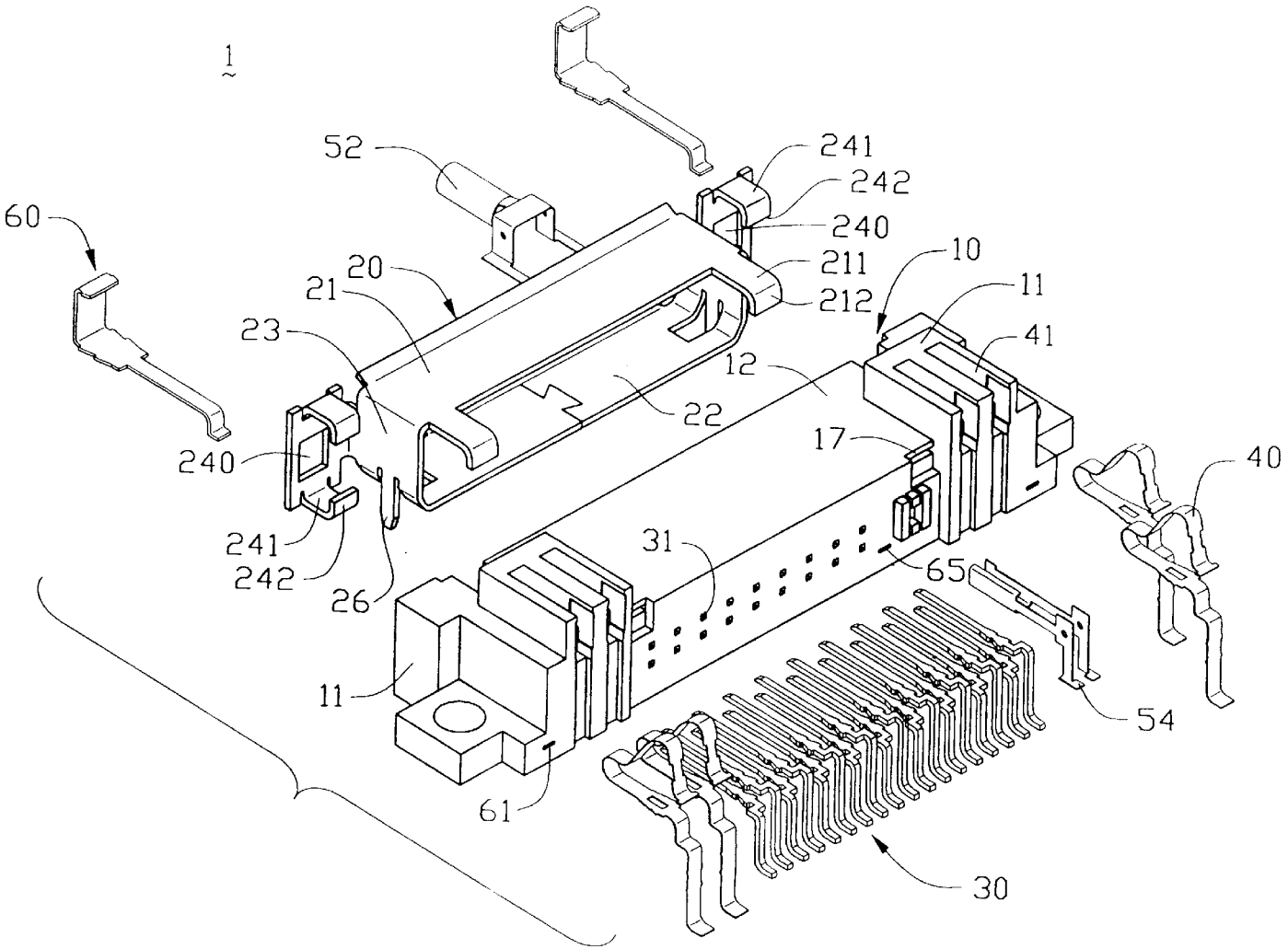
FIG. 1 is an exploded view of a receptacle connector in accordance with the present invention.
Figure 2:
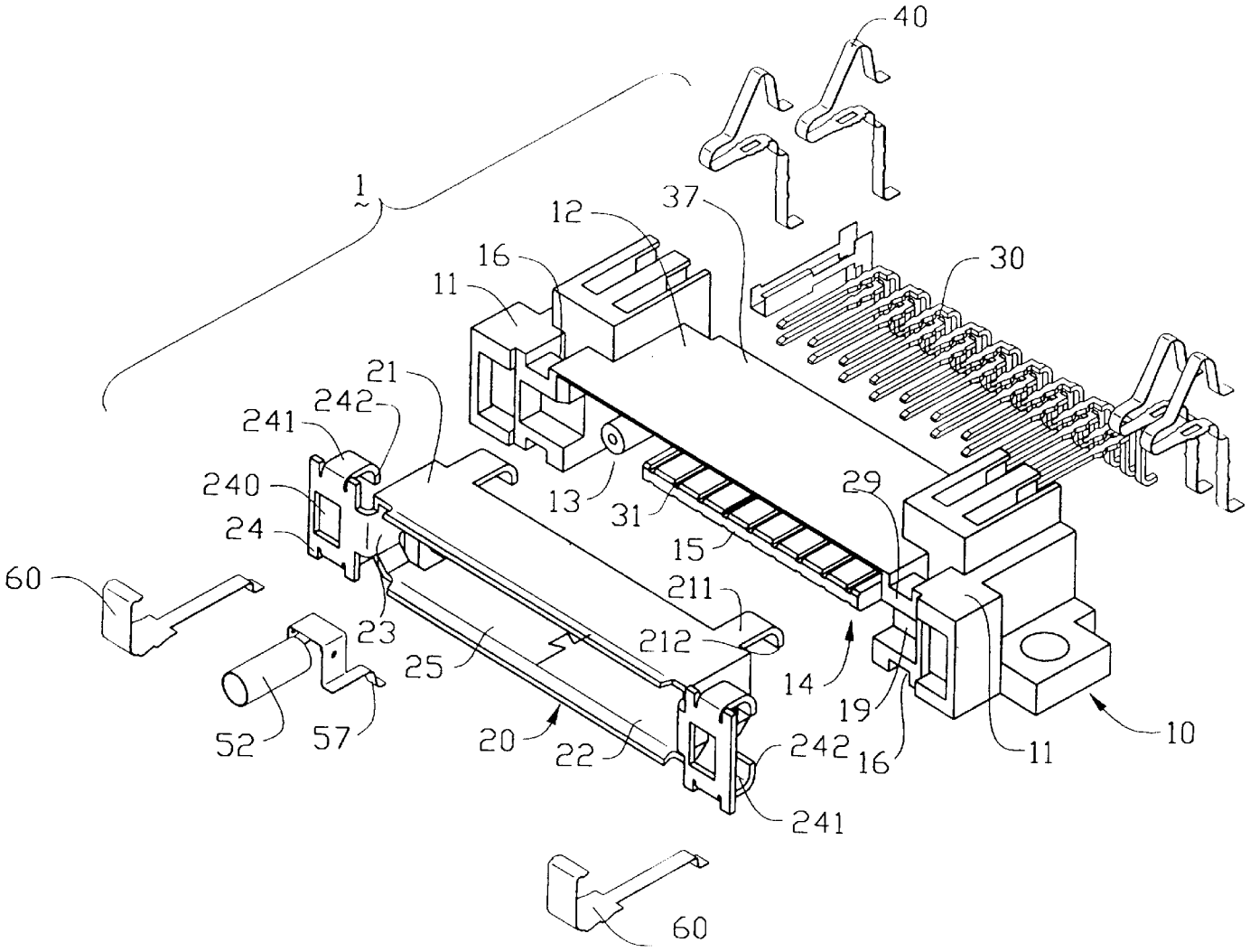
FIG. 2 is a view similar to FIG. 1 but taken from a different angle.

An electrical connector assembly in accordance with the present invention, as shown in FIGS. 1 and 2, includes a receptacle connector 1 disposed in an electrical device (not shown) and a plug connector 100 (FIG. 3) connected to an external power supply (not shown). The receptacle connector 1 comprises an elongate insulative housing 10, a metal shield 20, a plurality of signal contacts 30, four power contacts 40, a coaxial piece comprising a coaxial shell 52 and a coaxial contact 54, and a pair of charge contacts 60.

The housing 10 comprises two side portions 11 joined by a main body 12. A mating space 13 is defined between the side portions 11 and a top surface 37 of the main body 12. A protrusion 15 extends from the main body 12 into the mating space 13. A plurality of first passageways 31 are defined on upper and lower sides of the protrusion 15 through a rear face (not labeled) of the main body 12 for receiving the corresponding signal contacts 30 therein. Each signal contact 30 engages with corresponding contacts (not shown) of the plug connector 100.

Each side portion 11 of the housing 10 defines a pair of second passageways 41 along top and rear surfaces thereof for receiving the corresponding power contacts 40 therein. The power contacts 40 electrically connect with corresponding contacts of an internal battery (not shown) of the electrical device. A third passageway 61 is defined through each side portion 11 of the housing 10 for receiving the corresponding charge contact 60 therein. The charge contacts 60 electrically connect with a charging device (not shown) for recharging the internal battery of the electrical device.

The metal shield 20 is formed by stamping a metal sheet to have a top surface 21, a bottom surface 22, two side walls 23 connected between the top and bottom surfaces 21, 22 on opposite sides thereof, and a latching portion 24 outwardly extending from each side wall 23. A receiving space 25 is defined between the top and bottom surfaces 21, 22 and the side walls 23. A mounting post 26 downwardly extends from each side wall 23 for connecting to a grounding path formed on the PC board whereby electrostatic charges accumulated on a surface of the shield 20 can be directed to ground. Each latching portion 24 defines a square opening 240 therein for receiving a resilient latch 110 (FIG. 3) extending from the plug connector 100. First engaging arms 241 rearwardly extend from top and bottom portions of each latching portion 24, and second engaging arms 211 rearwardly extend from the top surface 21 of the shield 20. Each engaging arm 241, 211 forms a curved free end 242, 212 extending toward a central portion of the shield 20.

Figure 4:
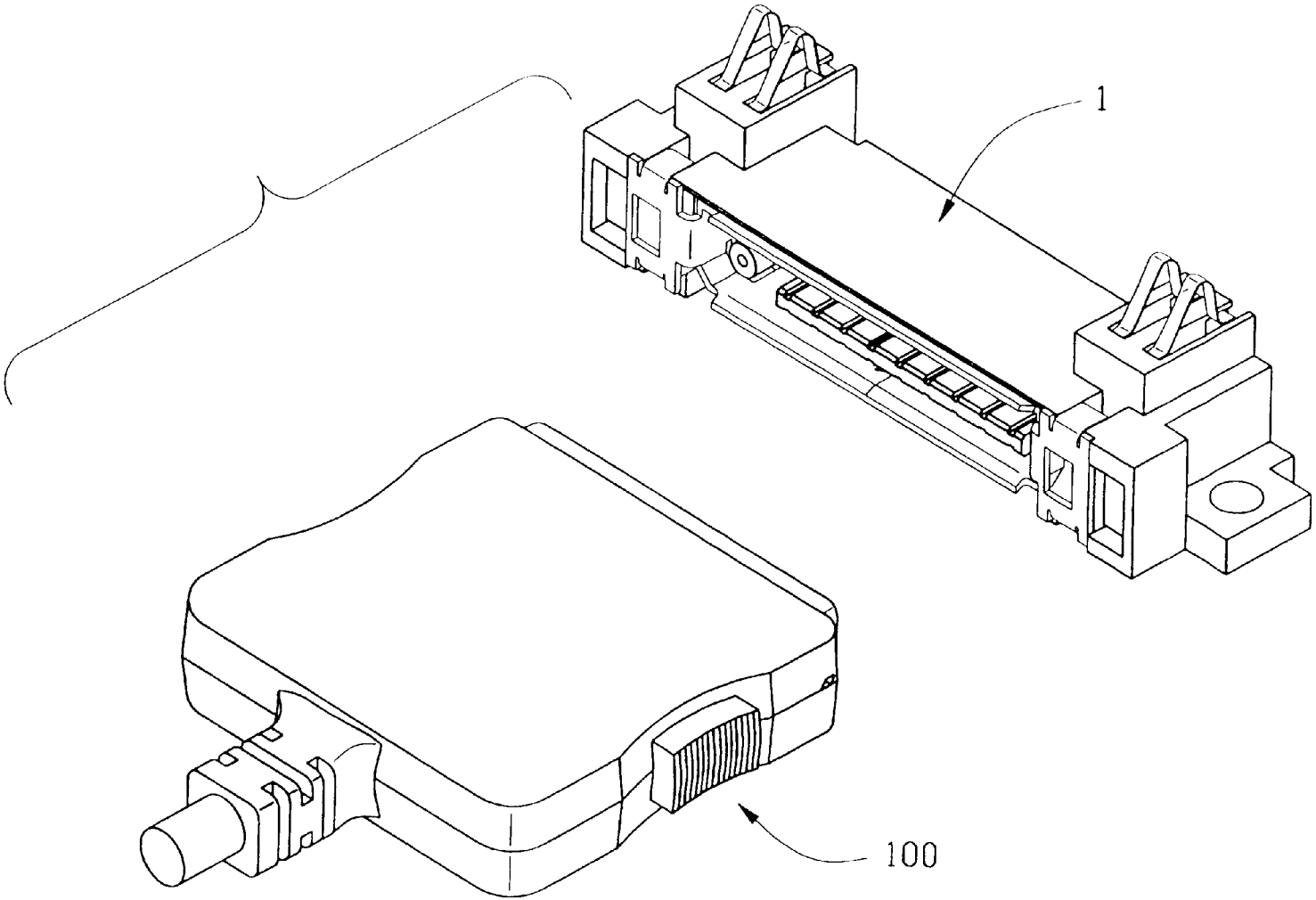
FIG. 4 is a perspective, view of the assembled receptacle connector and the mating plug connector to be engaged therewith.

To assemble the shield 20 to the housing 10, the protrusion 15 of the housing 10 is received in the receiving space 25 of the shield 20. The free ends 242 of the first engaging arms 241 securely engage with corresponding first apertures 16 defined in a front of the side portions 11 of the housing 10, and the free ends 212 of the second engaging arms 211 securely engage with corresponding second apertures 17 defined in the rear surface of the main body 12. Thus, the shield 20 is stably secured to the housing 10, as seen in FIG. 4.

Figure 3:
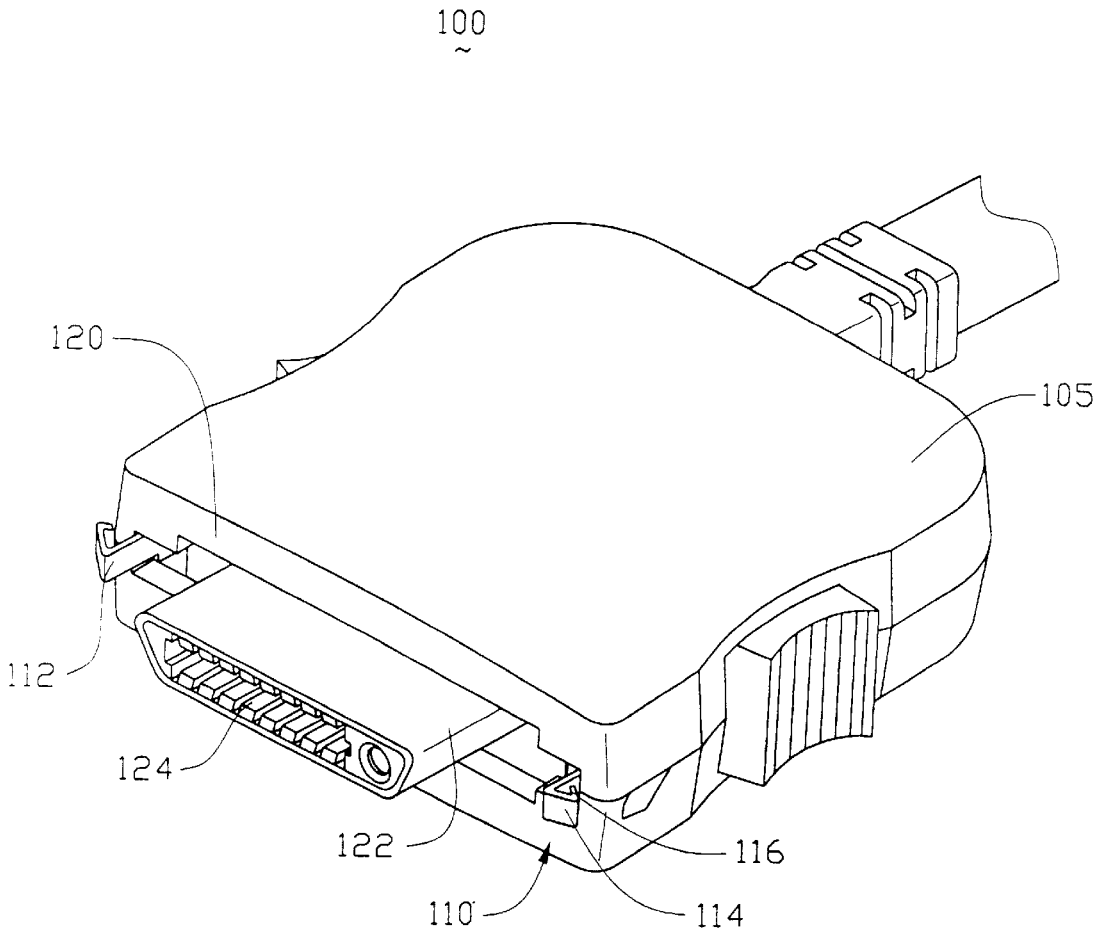
FIG. 3, is a perspective view of a plug connector, to be engaged with the receptacle connector

Referring to FIG. 3, the plug connector 100 includes a housing 105 having a mating face 120 and an elongate protrusion 122 extending therefrom for being received within the receiving space 25 of the receptacle connector 1. The protrusion 122 defines a channel 124 therein for receiving the protrusion 15 of the receptacle connector 1. The resilient latches 110 extend from the mating face 120 adjacent to distal ends of the protrusion 122. Each latch 110 has a first portion 112 outwardly extending from the mating face 120, a second portion 114 connected to the first portion 112 and extending away from the protrusion 122 toward the housing 105, and a third portion 116 connected to the second portion 114 and extending toward the first portion 112.

Figure 5:
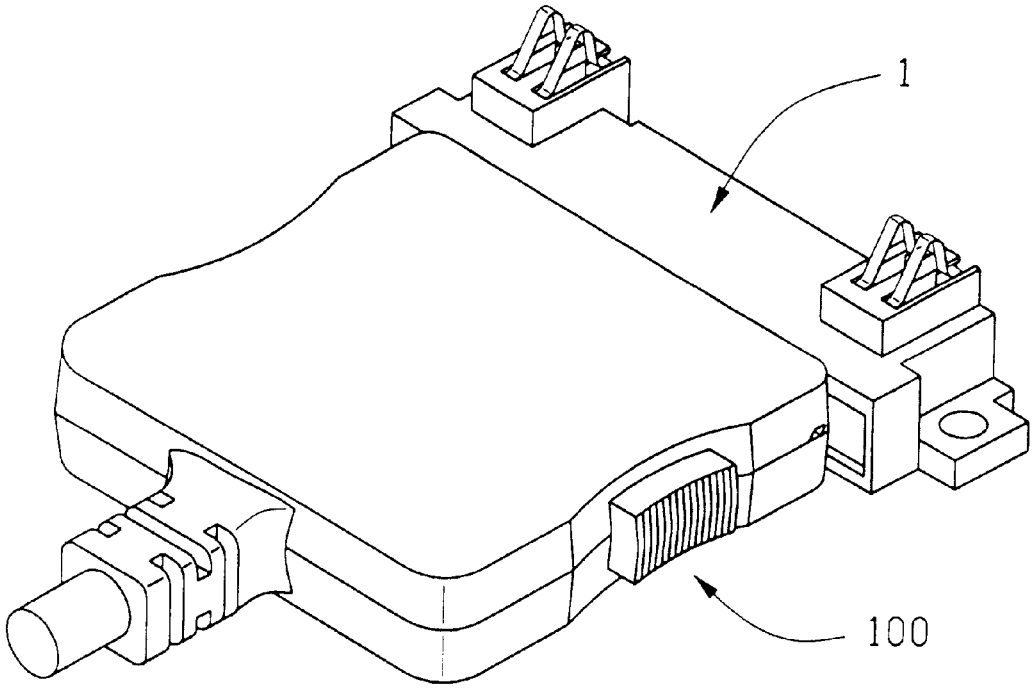
FIG. 5 is a perspective view of the receptacle and plug connectors assembled together.

Also referring to FIG. 5, when the plug connector 100 is engaged with the receptacle connector 1 the latches 110 extend through the corresponding openings 240 of the shield 20 in a front-to-back direction. A temporary deformation of each latch 110 occurs as the second portion 114 slides along an inner periphery of the opening 240 of the shield 20. The latch 110 resumes its original shape when the head, i.e., the second and third portions 114, 116 thereof, passes through the opening 240. The third portion 116 of the latch 110 firmly abuts a rear surface of the latching portion 24 thereby creating a significant abutment area therebetween. Thus, the engagement between the receptacle and plug connectors 1, 100 is greatly improved over the prior art.

The feature of the invention is to provide an internal shield 20 received within the mating space 13 of the housing 10 wherein the protrusion 15 of the housing 10 is surrounded by the shield 20 so as to efficiently shield EMI thereabouts. The shield 20 also provides reinforcement of the structure of the housing 10. It is noted that to lower the overall profile, the housing 10 only includes the top surface 37 without any opposite bottom surface thereof around the space 13 and thus leaves a downward opening 14 below the protrusion 15 so that the bottom surface 22 of the shield 20 is downwardly exposed to an exterior without being hidden by any portion of the housing 10.

It is contemplated that the latching performance is improved in the invention. The existing connector assembly uses a latch having a lateral locking open and embedded within the receptacle connector as shown in U.S. Pat. No. 5,622,522 to cooperate with another latch having a dimple thereon and attached to the plug connector as shown in U.S. Pat. No. 5,609,499. Due to the inherent limitation of such an arrangement, the latchable engagement area between these two latches takes only the thickness of the latch of the receptacle connector, thus resulting in unreliable situation. Differently, in the invention, the housing 10 includes a recess 19 recessed from a front face 29 of the side portion 11 of the housing 10 behind the latching opening 240 of the shield 20. Therefore, the second and third portions 114, 116 of the latch 110 of the plug connector 100 (FIG. 3) can be enlarged not only to enhance its own structure but also to increase the latchable engagement area between the third portion 116 of the latch 110 and the corresponding region beside the opening 240 of the shield 20.

Figure 6:
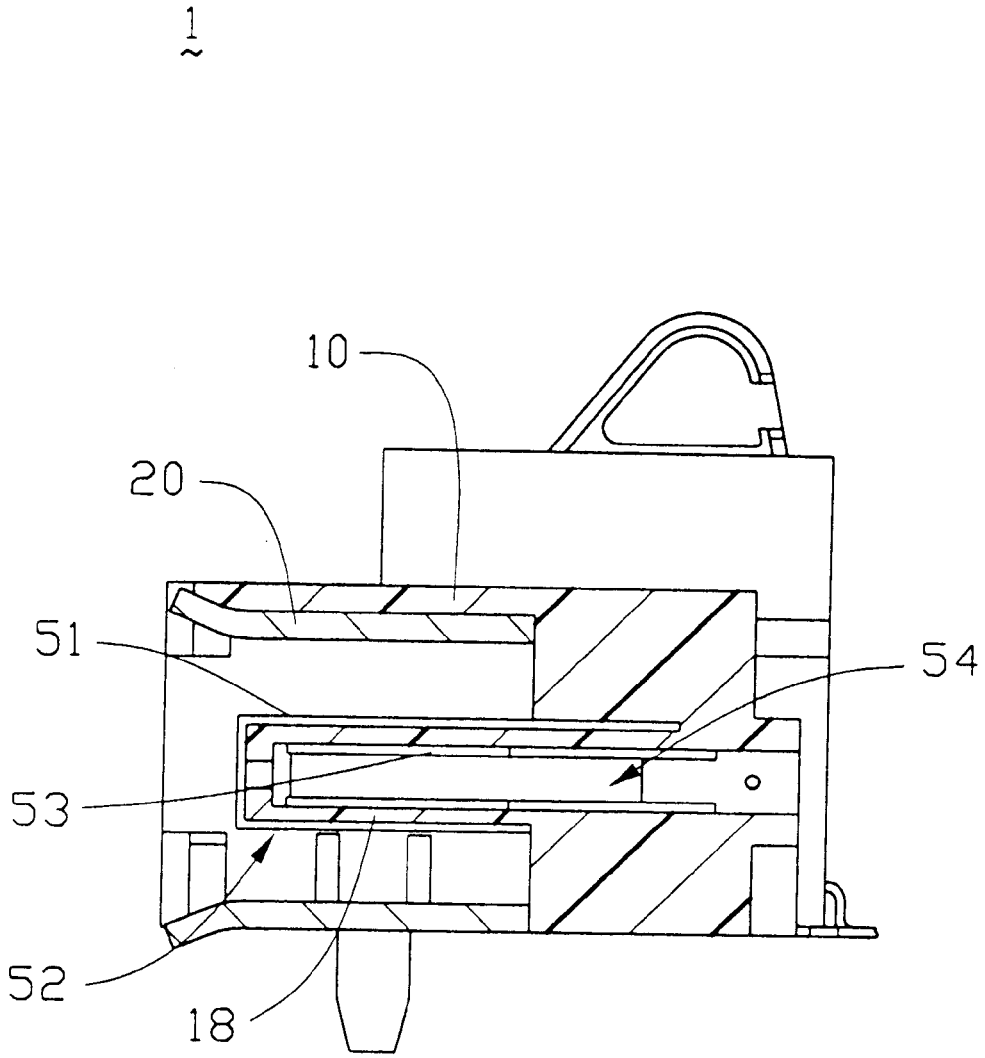
FIG. 6 is a cross-sectional view of the receptacle connector of FIG. 1 to show the corresponding structure of the coaxial piece.

It is also appreciated that in the invention the coaxial shell 52 of the coaxial piece is installed into the housing 10 from the front side while the coaxial contact 54 of the coaxial piece is installed into the housing 10 from the back side. The existing coaxial piece generally has its own coaxial shell and coaxial contact pre-assembled with its own internal dielectric body, and then simultaneously installed into the housing 10. In contrast, as shown in FIG. 6, in the invention the dielectric body of the coaxial piece is directly provided by the housing 10 including a tubular portion 18 which is adapted to receive the front portion 53 of the coaxial contact 54 and to be received within the front portion 51 of the coaxial shell 52. Additionally, the front loading of the coaxial shell 52 and the rear loading of the coaxial contact 54 may avoid unnecessary interference between these two items if they are assembled to the housing 10 from the same side, and may make it easy to form the complete tubular portion 18 with the housing 10 for cooperation with the inserted coaxial shell 52 and coaxial contact 54. It is also seen that the tails 57 (FIG. 2) of the coaxial shell 52 may respectively extend out of the corresponding apertures 65 (FIG. 1) in the housing 10 to be deflected downward to engage with the printed circuit board (not shown) under the connector 1. Understandably, signal contacts 30, power contacts 40 and coaxial contacts 54 are also soldered to the same printed circuit board, similarly.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. A receptacle connector comprising:

an elongate insulative housing having two side portions joined by a main body and defining a mating space between the side portions and the main body for receiving a mating portion of a plug connector;

a plurality of contacts disposed within the housing;

a metal shield received within the space of the housing, wherein the shield comprises a top surface, a bottom surface, a pair of side walls connected between the top and bottom surfaces on opposite sides thereof, said shield including a pair of latching portions respectively disposed on front faces of the side portions, said latching portion defining a latching opening therein, wherein said latching portion of the shield includes a first engagement arm for engaging with a first aperture in the said side portion and a second engagement arm for engaging with a second aperture in said other side portion of the housing; and a mounting post downwardly extends from at least one side wall of the shield for connecting to a grounding path formed on a printed circuit board;

each of said side portions of the housing including a recess recessed inward from the front face generally in alignment with said latching opening, so as to receive an enlarged head of a latch of the plug connector when the latch of the plug connector extends through the latching opening and the recess in a front-to-back direction.

* * * * *